US009655391B2

(12) United States Patent
Carver et al.

(10) Patent No.: US 9,655,391 B2
(45) Date of Patent: May 23, 2017

(54) PANTLEG HOLDING MECHANISM FOR KNEE PADS

(71) Applicant: 5 Seas Engineering & Trading LLC, Dittmer, MO (US)

(72) Inventors: John W. Carver, Dittmer, MO (US); Keith Ericson, Barnhart, MO (US)

(73) Assignee: 5 Seas Engineering & Trading LLC, Dittmer, MO (US)

( * ) Notice: Subject to any disclaimer, the term of this patent is extended or adjusted under 35 U.S.C. 154(b) by 694 days.

(21) Appl. No.: 13/781,333

(22) Filed: Feb. 28, 2013

(65) Prior Publication Data

US 2014/0237696 A1 Aug. 28, 2014

(51) Int. Cl.
*A41D 13/05* (2006.01)
*A41D 13/06* (2006.01)

(52) U.S. Cl.
CPC ..... *A41D 13/0568* (2013.01); *A41D 13/0575* (2013.01); *A41D 13/065* (2013.01)

(58) Field of Classification Search
CPC ..... A41D 13/0568; A41D 13/0575; A41D 13/065; A41D 13/06; A41D 27/205
USPC ..... 2/22, 23, 24, 247, 248, 249, 250, 267
See application file for complete search history.

(56) References Cited

U.S. PATENT DOCUMENTS 891,533 A 6/1908 Gibbs
1,225,799 A * 5/1917 Goldsmith ..... A41D 13/065 2/22
1,446,251 A * 2/1923 Goldsmith ..... A41D 1/08 2/228
1,636,553 A * 7/1927 Cruden ..... A41D 1/08 2/23
1,669,085 A * 5/1928 Guyon ..... A41D 1/08 2/23
1,896,561 A * 2/1933 Ruth ..... A41D 13/0568 128/112.1
1,946,173 A * 2/1934 Miller ..... A41D 27/20 2/248
2,561,872 A 7/1951 Krinick
2,568,083 A * 9/1951 Mitchell ..... A41D 13/0556 2/23

(Continued)

FOREIGN PATENT DOCUMENTS

EP 0697178 A2 2/1996
FR 2870432 A1 11/2005

OTHER PUBLICATIONS

European Search Report dated Sep. 15, 2015.

*Primary Examiner* — Alissa L Hoey
(74) *Attorney, Agent, or Firm* — Husch Blackwell LLP

(57) ABSTRACT

A knee pad holding mechanism for holding a knee pad over the knee region of a pantleg having a first length of fabric material and a second length of fabric material operatively secured together to form a pocket, the pocket being sized and shaped to receive a knee pad and having at least one opening located along each of the outside edges of the pocket for receiving a strap associated with the knee pad. In one embodiment, the first length of fabric material can be secured directly to the knee region of a pantleg wherein the pantleg forms the second length of fabric material. Other embodiments include using a loop, eyelet, slits or an additional section of fabric having a slit associated therewith for receiving a strap associated with the knee pad. The present mechanism is also adaptable for use to receive an elbow pad.

9 Claims, 5 Drawing Sheets

(56) References Cited

U.S. PATENT DOCUMENTS 2,663,876 A * 12/1953 Miller ..... A41D 1/06 2/227
3,346,877 A * 10/1967 Zirves ..... A41D 13/0568 2/24
3,438,062 A * 4/1969 Dobell ..... A41D 27/20 2/247
4,079,871 A * 3/1978 Sica ..... A63B 47/001 2/247
4,561,123 A 12/1985 Hull
4,699,401 A * 10/1987 Saenz ..... B60R 22/00 224/602
4,791,681 A * 12/1988 Dean ..... A41D 27/20 2/102
5,210,881 A * 5/1993 Stocker, Jr. ..... A41D 27/20 2/115
5,732,412 A 3/1998 Holden
5,870,777 A * 2/1999 Hans ..... A41D 27/20 2/228
6,070,267 A 6/2000 McKewin
6,339,848 B1 * 1/2002 Mayhood ..... A41F 9/002 2/338
6,347,403 B1 * 2/2002 Wilcox ..... A41D 13/0556 2/23
6,421,839 B1 7/2002 Vo
6,574,800 B1 * 6/2003 Leger ..... A41D 13/1245 2/114
6,704,938 B2 * 3/2004 Crockett ..... A41D 13/065 2/23
6,832,390 B1 * 12/2004 Kleinert ..... A41D 13/0568 2/22
6,988,281 B1 * 1/2006 Jerome ..... A41D 13/065 2/24
7,194,770 B1 3/2007 Fecenko
7,380,283 B1 6/2008 Dumont
7,490,360 B2 2/2009 Meadows
7,908,675 B2 * 3/2011 Robinson ..... A41D 27/20 2/247
7,950,067 B2 5/2011 Williams
8,719,966 B2 * 5/2014 Grozdev ..... A41D 13/0012 2/247
9,021,615 B2 * 5/2015 Cockram ..... A41D 1/06 2/236
9,144,253 B1 * 9/2015 Munter ..... A41D 13/065
9,167,856 B1 * 10/2015 Pacific ..... A41D 13/065
2003/0074719 A1 * 4/2003 Crye ..... A41D 27/28 2/247
2006/0253954 A1 * 11/2006 Music ..... A41D 13/0051 2/115
2007/0050877 A1 3/2007 Rampersad
2007/0150993 A1 * 7/2007 Oh ..... A41D 13/0556 2/24
2008/0289082 A1 * 11/2008 Harris ..... A41D 27/20 2/251
2009/0139013 A1 * 6/2009 Sapowycz ..... A41D 1/005 2/247
2009/0144873 A1 * 6/2009 Jewell ..... A41D 13/0581 2/24
2009/0158494 A1 * 6/2009 McMullen ..... A01K 1/029 2/102
2009/0282600 A1 * 11/2009 Robinson ..... A41D 27/20 2/79
2009/0300818 A1 * 12/2009 Waite ..... A41D 1/14 2/76
2010/0235960 A1 * 9/2010 Johnson ..... A41D 13/065 2/23
2011/0185471 A1 * 8/2011 Buczkowski ..... A41D 3/00 2/84
2013/0061365 A1 * 3/2013 Arceo ..... A41D 13/065 2/24

* cited by examiner

PANTLEG HOLDING MECHANISM FOR KNEE PADS

BACKGROUND OF THE INVENTION

The present invention relates generally to clothing and, more particularly, to a pantleg holding mechanism for securing a knee pad to a pantleg or other portion of a garment.

Construction workers, mechanics, repairmen, plumbers, electricians, cleaning staff and other types of workers participate in a substantial amount of physical labor due to the nature of their respective jobs and much of this work requires the worker to spend a substantial amount of time on their knees. Crouching on one's knees is a common practice in such fields due to the nature of specific jobs and because such a position provides workers with access to a particular job location or to various things which require their attention but are difficult to reach in an upright or seated position. Frequently applying pressure to one's knees in this manner oftentimes results in chronic pain and/or permanent knee injury. To alleviate this type of pressure on one's knees, laborers often wear knee pads during the course of their work to provide comfort and support to the knees, while still allowing them to kneel as necessary.

A variety of knee pads have been designed in an attempt to provide such cushioning and support to a person's knees with varying degrees of success. Oftentimes knee pads fail to stay properly positioned directly over the knees, frequently moving around or sliding down the worker's leg as the wearer moves or shifts on their knees from one location to another during the course of their work. Thus, it would be desirable to develop a knee pad holding mechanism for positioning and securing a knee pad in such a way that movement of the knee pad is minimized during use.

SUMMARY OF THE INVENTION

The present invention is directed to a knee pad holding mechanism which is specifically designed for locating and securing a knee pad in a proper, fixed position to a pantleg. Specifically, the present mechanism is designed for individuals who are required to spend a great deal of time on their knees. This has application in the trade and laborer industry as well as in certain military applications. The present mechanism is constructed so that a knee pad may be removably attached to a pantleg in a fixed stable position. The present mechanism includes a first length of fabric material and a second length of fabric material which are secured together to form a pocket. The pocket is designed for receiving the knee pad. At least one opening is formed along each of the outside side edges of the pocket for receiving and holding at least one fastening strap associated with the knee pad. In some embodiments, the fabric material of the pantleg may define the second length of fabric material for forming the pocket. The openings may likewise include a plurality of different holding means for holding the knee pad fastening straps in a fixed stable position on the pantleg.

The present pad holding mechanism may also be utilized in other areas or regions of a particular garment such as over the elbow region of a shirt sleeve or other garment for receiving and holding an elbow pad in a fixed stable position on the garment.

Specific advantages and features of the present assembly will be apparent from the accompanying drawings and the description of several illustrative embodiments of the present invention.

It should be understood that the present drawings are not necessarily to scale and that the embodiments disclosed herein are sometimes illustrated by fragmentary views. In certain instances, details which are not necessary for an understanding of the present invention or which render other details difficult to perceive may have been omitted. It should also be understood that the invention is not necessarily limited to the particular embodiments illustrated herein. Like numbers utilized throughout the various figures designate like or similar parts or structure.

DETAILED DESCRIPTION

Figure 1:
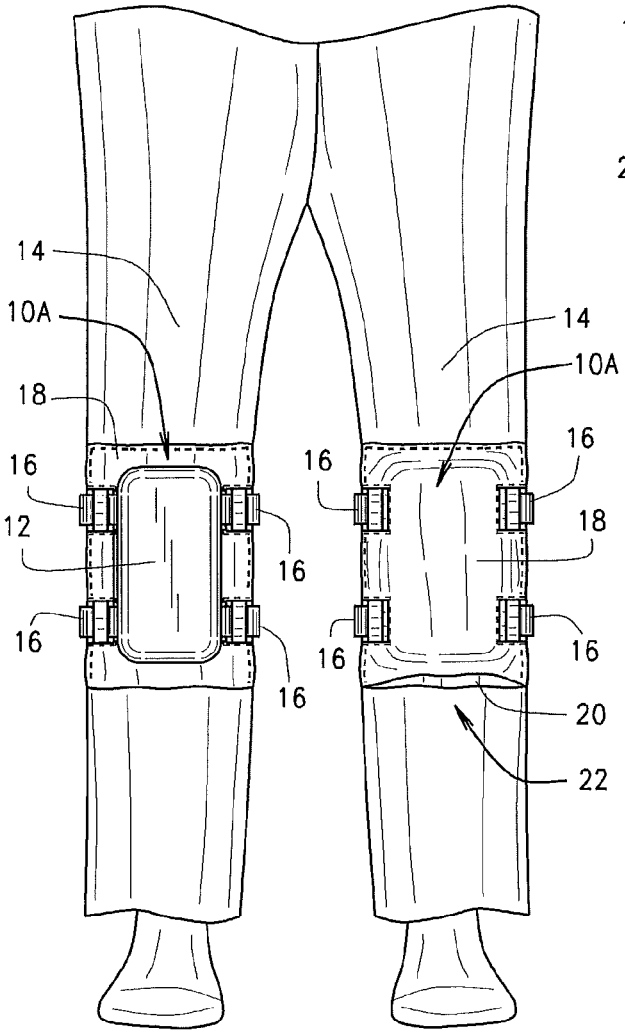
FIG. 1 is a front elevational view of one embodiment of a pantleg knee pad holding mechanism constructed in accordance with the teachings of the present invention showing a knee pad positioned on the present mechanism on the wearer's right leg and showing a knee pad positioned within the pocket associated with the present mechanism on the wearer's left leg.

Referring now to the drawings more particularly by reference numbers, FIG. 1 illustrates one embodiment of a knee pad holding mechanism 10A which is designed for securing a knee pad 12 to a pantleg 14 and positioning it substantially over the knee region of the garment, the present mechanism 10A minimizing movement of the knee pad 12 while the wearer moves during the course of his/her work activities as will be hereinafter further explained. The mechanism 10A is designed for individuals who are required to spend a great deal of time on their knees due to the nature of their trade and is constructed such that the knee pad 12 may be removably attached to a pantleg 14 as needed. The mechanism 10A cooperates with the fastening straps 16 associated with the knee pad 12 to properly position the knee pad 12 relative to the pantleg 14. Although the present mechanisms will be described in connection with one embodiment of a typical knee pad 12, it is likewise wellsuited for use with essentially any type of knee pad construction as well as with elbow pads as will be further explained.

Figure 2:
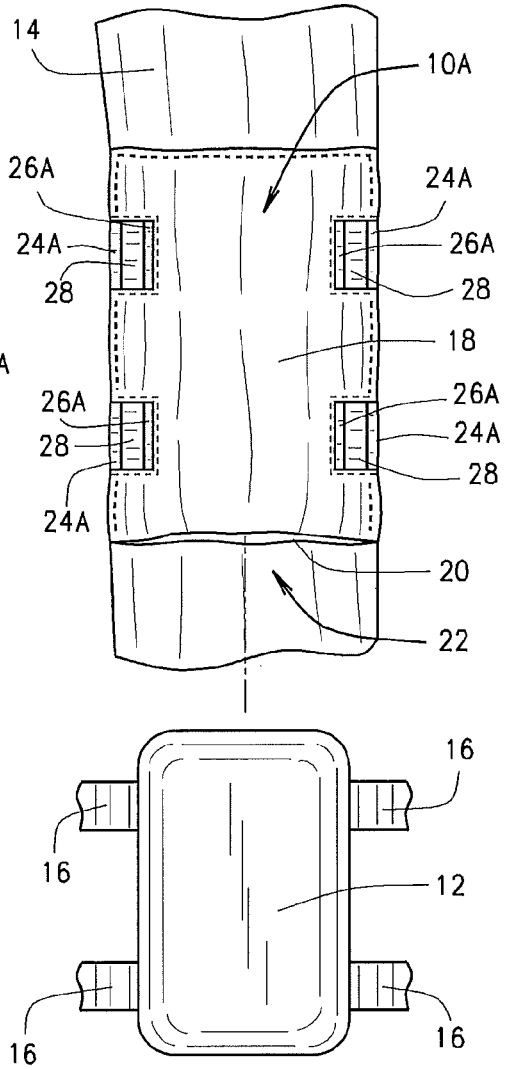
FIG. 2 is an enlarged partial exploded front elevational view of the present mechanism of FIG. 1 showing a knee pad ready for insertion within the pocket associated with the present mechanism.
Figure 3:
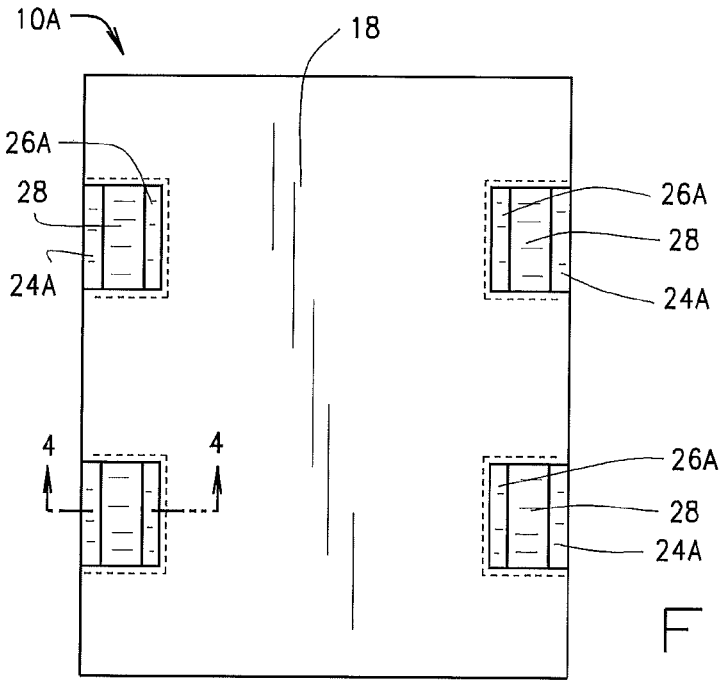
FIG. 3 is an enlarged partial front elevational view of the present mechanism of FIG. 1.
Figure 4:
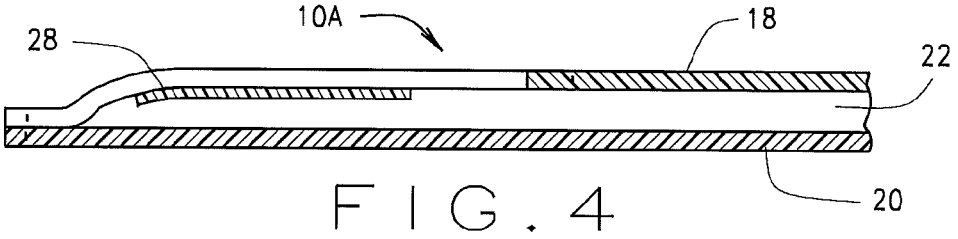
FIG. 4 is a cross-sectional view of the present mechanism taken along line 4-4 of FIG. 3.

As illustrated in FIGS. 2-4, the mechanism 10A includes a first length of fabric material 18 and a second length of fabric material 20, the first length of fabric 18 being secured to the second length of fabric 20 in a manner which forms a pocket 22. The pocket 22 is designed for receiving the knee pad 12. The first length of fabric material 18 may be secured to the second length of fabric material 20 using any suitable attachment means including, but not limited to, stitching, adhesives, glue, welt, fusion bonding, direct attachment constructions and the like. A plurality of pocket openings 24A are formed at preferably at least two intermediately spaced intervals along each of the two opposed outside edges of the mechanism 10A. The first length of fabric material 18 and the second length of fabric material 20 are not attached to each other at the respective openings 24A and each opening provides access to the interior of the pocket 22. The openings 24A are positioned and located in opposed relationship to each other along each of the outside edges of the mechanism 10A as illustrated in FIGS. 1-3 so that the straps 16 associated with the knee pad 12 can be fed through a pair of opposed pocket openings 24A for fastening the straps to the back portion of a person's leg. In this regard, the opposed pocket openings are positioned and located on the mechanism 10A so as to receive the straps associated with a typical knee pad such as the knee pad 12. It is also recognized that a single pair of opposed openings 24A could likewise be used and achieve the same result of fixedly securing the knee pad 12 and preventing the same from moving or shifting vertically during use.

In one embodiment, the first length of fabric material 18 may further include a plurality of cut-outs 26A as illustrated in FIGS. 1-3, each cut-out 26A being positioned and located so as to form a corresponding pocket opening 24A when the first length of fabric material 18 is overlaid with the second length of fabric material 20 so as to provide an adequate amount of space for receiving a fastening strap 16 associated with a knee pad 12. Each cut-out 26A includes a loop or eyelet 28, each loop or eyelet 28 cooperating with its corresponding opening 24A to create an area or an additional opening for a fastening strap 16 to be threaded therethrough to further fixedly secure the knee pad 12 to the pantleg 14. Threading the straps 16 over or around the loops 28 further prevents the knee pad 12 from moving vertically up or down when positioned on or within the pocket 22 as will be further explained. In one embodiment, each cut-out 26A may be substantially rectangularly-shaped, although it is envisioned that in alternative embodiments, each opening 24A may be formed in a variety of different shapes, as desired, without departing from the spirit and scope of the present invention.

In another embodiment, the first length of fabric material 18 may be operably attached directly to the front knee region of the pantleg 14 so as to form the pocket 22 between the first length of fabric 18 and the fabric material forming the pantleg 14. In this embodiment, the second length of fabric 20 is not used and instead the fabric material forming the front knee region of the pantleg 14 forms the second length of fabric 20. Furthermore, in one embodiment, the mechanism 10A may be positioned with the opening of the pocket 22 facing downward as shown in FIGS. 1 and 2, the closed end of the pocket 22 serving to assist in the positioning of the knee pad 12 directly over the knee. In an alternative embodiment (not shown), the mechanism 10A may be positioned with the opening of the pocket 22 facing upward. In still another embodiment (not shown), the pocket 22 may have an opening at each end forming a channel therethrough in the vertical direction such that the knee pad 12 may be inserted and/or removed from either end of the channel. In alternative embodiments, a suitable amount of foam may be positioned within the pocket 22, the foam serving substantially the same function and/or acting as a substitute for the knee pad 12.

Still further, the first length of fabric material 18 and the second length of fabric material 20 may be formed from the same material as the pantleg 14 such that pants which include the mechanism 10A may be aesthetically pleasing to the wearer, with or without the knee pad 12 positioned therewithin, and such a construction may likewise serve to conceal the knee pad 12 when it is inserted into the pocket 22. In an alternative embodiment, the first length of fabric material 18 and/or the second length of fabric material 20 may be formed from any suitable material which provides a non-slip surface for increased stability and/or increased durability.

In use, the knee pad 12 may be positioned on top of the first length of fabric material 18 as illustrated in FIG. 1 with each of the fastening straps 16 threaded through the corresponding loops or eyelets 28 if the wearer does not desire to use the pocket 22. By threading the straps 16 associated with a knee pad 12 under the loops 28 likewise prevents the knee pad 12 from moving or shifting vertically during use.

FIG. 4 is a cross-sectional view taken along line 4-4 of FIG. 3 showing the interior of pocket 22 and the positioning and location of the first length of fabric material 18, the second length of fabric material 20, and the loop or eyelet 28 relative to each other.

Figure 5:
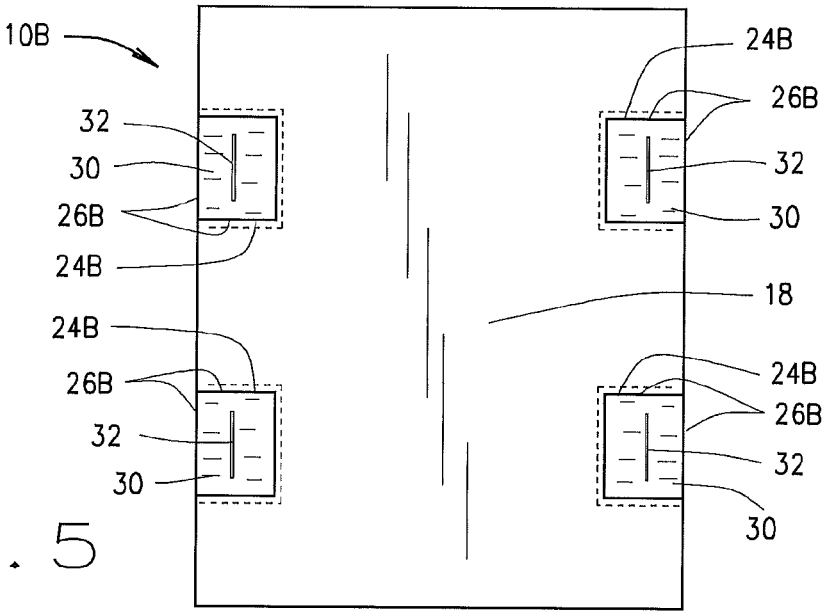
FIG. 5 is an enlarged partial front elevational view of another embodiment of the present mechanism constructed in accordance with the teachings of the present invention.

FIG. 5 illustrates an alternative embodiment of the present mechanism 10B where each pocket opening 24B further includes a cut-out 26B having a section of fabric 30 operably attached thereto. Each section of fabric 30 further includes an elongated opening or a slit 32 for receiving a fastening strap 16 and is attached within each opening 24B on three sides, each fourth side of each section of fabric 30 being left open to both create an opening for access to the interior of the pocket 22 and to cooperate with its corresponding slit 32 to create an area for a fastening strap 16 to be threaded therethrough. In one embodiment, each of the sections of fabric 30 may be formed from the same material as the first length of fabric material 18, the second length of fabric material 20 and/or the pantleg 14. If fabric 30 is the same fabric material as the first length of fabric 18, a cut-out 26B is not necessary and the slit 32 can be formed in the first length of fabric 18 near each respective opening 24B. In this regard, the first and second lengths of fabrics 18 and 20 are not attached to each other at each opening 24B so that access to the interior of pocket 22 is still provided. In an alternative embodiment, each of the sections of fabric 30 may be formed from a different type of material which is strong enough to support the structure of a fastening strap 16 when it is positioned through the slit 32 and which is strong enough to survive the normal wear and tear of the strap engaging and moving across the fabric 30 when the strap 16 is engaged with the slit 32. As with the present mechanism 10A illustrated in FIG. 1, the knee pad 12 can be placed over or within the pocket 22 of mechanism 10B for operative use as discussed above with respect to mechanism 10A.

Figure 6:
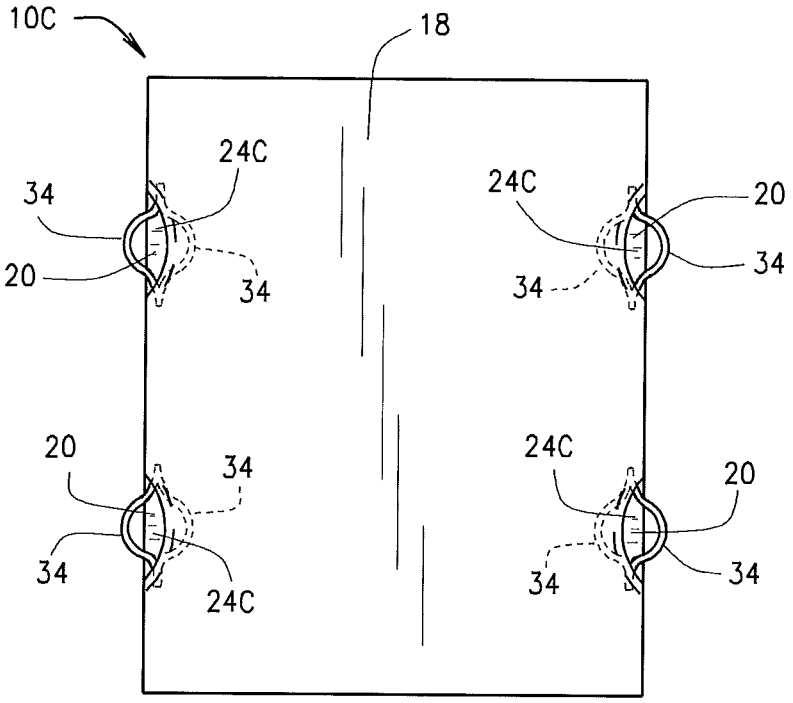
FIG. 6 is an enlarged partial front elevational view of a further embodiment of the present mechanism constructed in accordance with the teachings of the present invention.

FIG. 6 illustrates still another alternative embodiment of the present mechanism 10C where the first length of fabric material 18 and the second length of fabric material 20 overlap each other and form at least one side pocket opening 24C along each of the two opposed outside edges of the mechanism 10C. The first length of fabric material 18 further includes a plurality of loops 34, each loop 34 being substantially positioned and aligned with a corresponding side pocket opening 24C to create an area or an additional opening for a fastening strap 16 to be threaded therethrough. In an alternative embodiment, each loop 34 may be attached to the second length of fabric material 20, as desired, without departing from the spirit and scope of the present invention. The loops 34 are positioned such that they can be tucked inside the respective openings 24C and within the outer perimeter of the fabrics 18 and 20 so as hide the respective loops 34 within the openings 24C. This presents a more aesthetically pleasing look when a knee pad 12 is not being used. In this embodiment, the outside edges of the fabric materials 18 and 20 forming the openings 24C can be in substantial alignment with each other to form a clean, smooth external appearance and substantially hiding the openings 2C.

Figure 7:
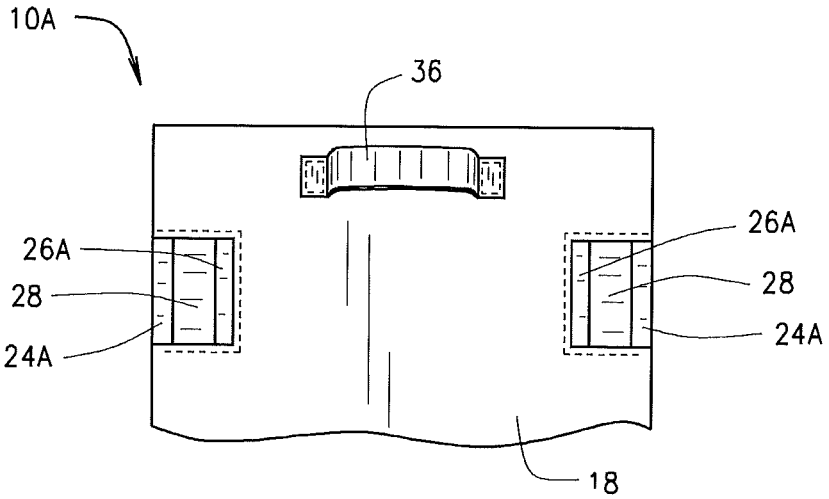
FIG. 7 is an enlarged partial front elevational view of still another embodiment of the present mechanism constructed in accordance with the teachings of the present invention.

As illustrated in FIG. 7, the present mechanism 10A may further include an additional loop or support member 36 which is secured to the upper portion of the first length of fabric material 18 using any reasonable attachment mechanism. The loop 36 is designed for receiving an additional strap or fastening device 16 which may be secured to the top portion of a typical knee pad (not shown). The loop 36 serves to provide additional positioning and security for the knee pad when this additional knee pad strap is further secured to the loop 36 thereby further preventing the knee pad 12 from moving or slipping downward in the vertical direction.

Figure 8:
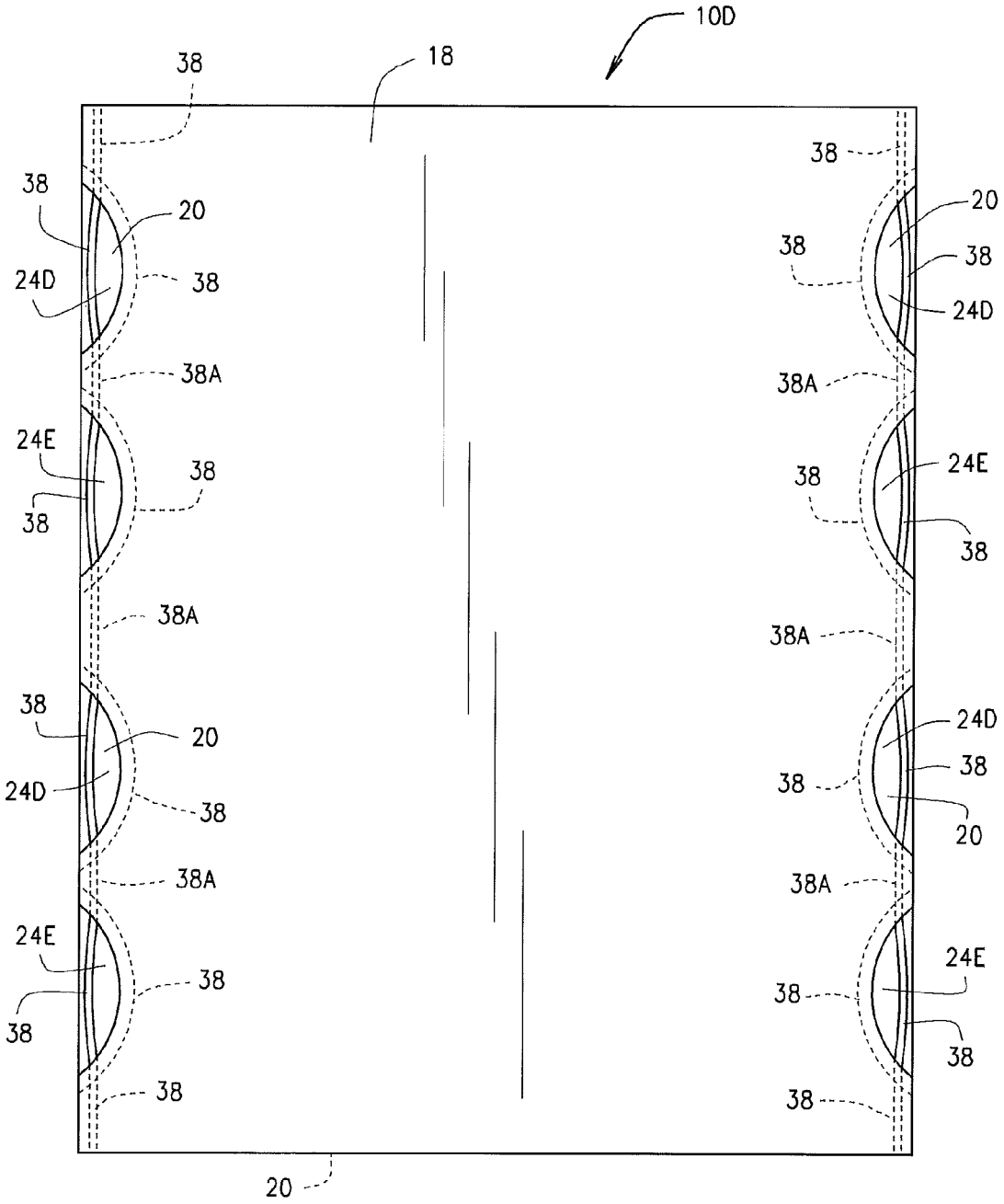
FIG. 8 is an enlarged partial front elevational view of still another embodiment of the present mechanism constructed in accordance with the teachings of the present invention.

FIG. 8 illustrates still another alternative embodiment of the present mechanism 10D, which embodiment is somewhat similar to the mechanism 10C illustrated in FIG. 6. The mechanism 10D includes a first length of fabric 18 which overlaps a second length of fabric 20 so as to again form side pocket openings 24D and 24E along each of the two opposed outside edges of the mechanism 10D. In this particular embodiment, two respective pairs of opposed side pocket openings 24D and 24E are included in the present mechanism so as to allow for some adjustability of the knee pad 12 relative to a person's knee. A plurality of loops 38 are positioned and aligned with a corresponding side pocket opening 24D and 24E so as to create an area or an additional opening for a fastening strap 16 associated with a knee pad 12 to be threaded therethrough. In the particular embodiment illustrated in FIG. 8, the plurality of loops 38 are associated with a single cord, fabric or other material which extends substantially the full length of both fabric materials 18 and 20 as best illustrated in FIG. 8. The cord or other material 38 can be attached at its opposite end portions, and at its intermediate locations 38A between the respective side openings 24D and 24E, to either the first length of fabric material 18 or the second length of fabric material 20, as desired, without departing from the spirit and scope of the present embodiment. Again, the loop portions 38 which are positioned and aligned with the corresponding side openings 24D and 24E are not attached or otherwise fastened to either fabric material 18 or 20 so as to allow a fastening strap 16 to be threaded therethrough.

The loops 38 are positioned such that they can be tucked inside their respective openings 24D and 24E and within the outside parameter of the fabrics 18 and 20 so as to hide the respective loops 38 within the respective openings as previously explained with respect to the embodiment illustrated in FIG. 6. This again presents a more aesthetically pleasing look when a knee pad 12 is not being used. In this particular embodiment, the pair of fastening straps 16 typically associated with a typical knee pad such as the knee pad 12 illustrated in FIG. 2 can be threaded through the corresponding loops 38 associated either with the respective pairs of side openings 24D or with the respective pairs of side openings 24E as previously explained. Using side openings 24D will position the knee pad 12 in one particular location relative to a person's knee, and using the side openings 24E will position the knee pad 12 in a different position relative to a person's knee and relative to the location of the side openings 24D.

The fastening strap 16 associated with a typical knee pad 12 can be fed through a pair of opposed side openings 24D or 24E for fastening the straps to the back portion of a person's leg as previously explained so as to allow the user some adjustability of the knee pad 12 relative to the person's knee. In this regard, as previously explained, the opposed openings 24D and 24E are positioned and located on the mechanism 10D so as to receive the straps associated with a typical knee pad such as the knee pad 12. Positioning the straps 16 associated with a typical knee pad 12 through the pair of respective side openings 24D will locate the knee pad 12 in a slightly higher position relative to a person's knee as compared to positioning the straps 16 associated with a typical knee pad 12 through the respective side openings 24E. In all other respects, embodiment 10D is substantially similar to embodiment 10C illustrated in FIG. 6.

In addition, it is also recognized and anticipated that the loops 38 can be individually formed within each respective side opening 24D and 24E and each individual loop 38 can be respectively attached to either fabric material 18 or 20, or the single cord or fabric material 38 can be formed in any number of a plurality of sections to achieve the stated objective.

Figure 10:
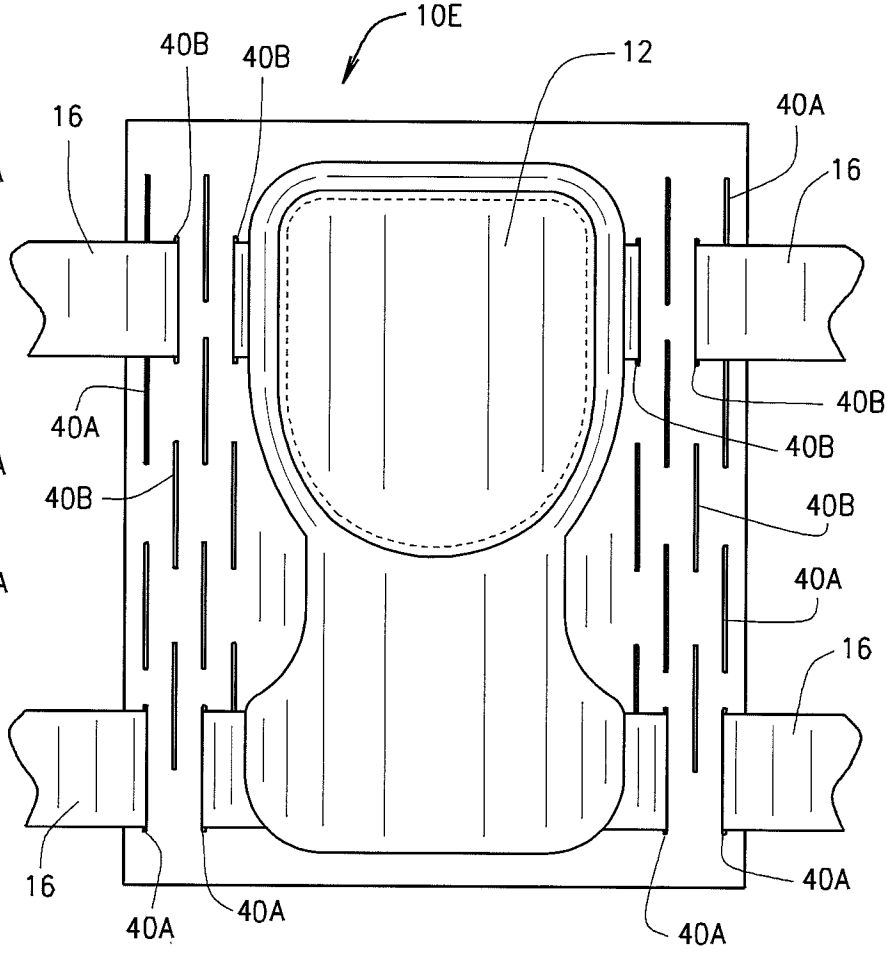
FIG. 10 is an enlarged partial front elevational view of the embodiment of FIG. 9 showing a knee pad positioned on the present mechanism and the fastening straps threaded through a respective pair of opposed elongated slits.
Figure 9:
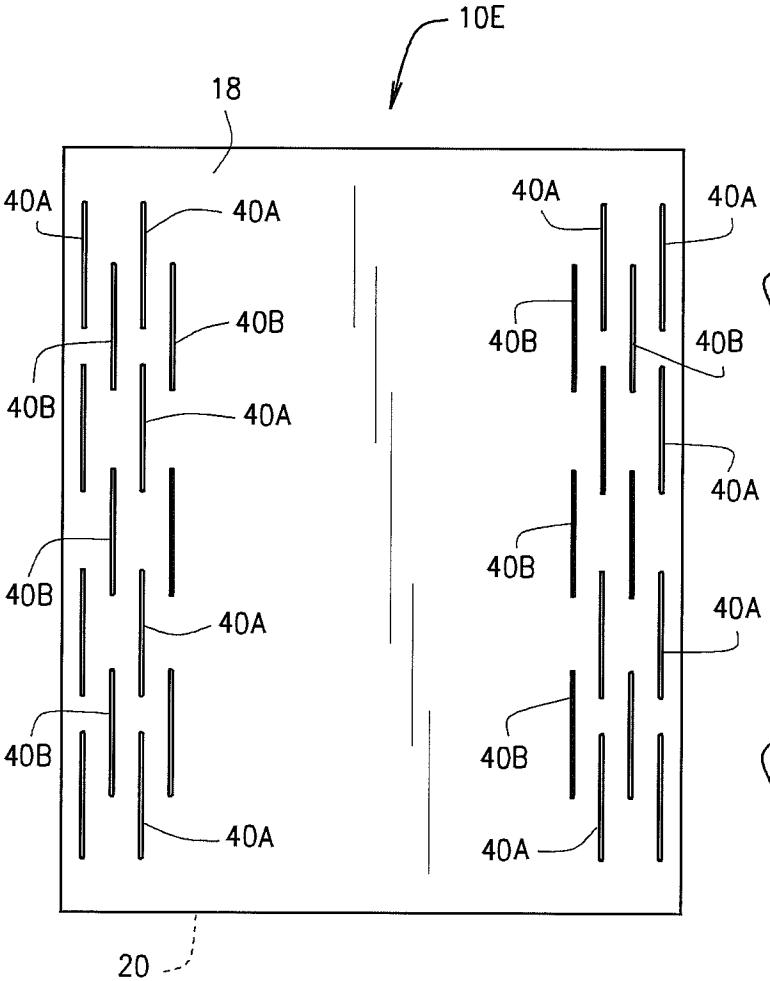
FIG. 9 is an enlarged partial front elevational view of a still further embodiment of the present invention constructed in accordance with the teachings of the present invention.

FIGS. 9 and 10 illustrate still another embodiment of the present mechanism 10E wherein the plurality of side openings such as the openings 24A-E illustrated in FIGS. 2, 3 and 5-8 are replaced with a plurality of pairs of opposed and preferably offset elongated openings, slits or slots as best illustrated in FIG. 9 for receiving a fastening strap 16 associated with a typical knee pad 12 as will be hereinafter further explained. The present mechanism 10E may include a first length of fabric material 18 which overlays a second length of fabric material 20, the fabric materials 18 and 20 being attached to each other using any suitable attachment means as previously explained so as to allow an open space between the fabric materials 18 and 20 for feeding the fastening straps 16 associated with a typical knee pad through the respective slits as will be hereinafter further explained. This may include attaching the outside edges of the fabric materials 18 and 20 to each other along the entire perimeter of the respective fabric materials, or leaving some portions of the outside side perimeter edges of the respective fabric materials 18 and 20 unattached to as to more easily allow for the feeding of the fastening straps 16 through any respective opposed pair of slits as will be hereinafter further explained. It is also recognized that the first length of fabric material 18 which contains the opposed pairs of respective slits may be operatively attached directly to the front knee region of the pantleg 14 such that the open space for feeding the fastening straps of a typical knee pad 12 will be formed between the first length of fabric 18 and the fabric material foaming the pantleg 14. In this particular embodiment, the second length of fabric 20 is not used.

More particularly, the first length of fabric material 18 associated with the present mechanism 10E as illustrated in FIGS. 9 and 10 includes a plurality of opposed pairs of openings, slots or slits 40A and 40B as best illustrated in FIG. 9. Each of the pair of plurality of slits 40A located on each opposite side of the mechanism 10E are positioned in substantially vertical alignment with each other as illustrated in FIGS. 9 and 10. Each of the plurality of opposed pairs of slits 40B located on each opposite side of the mechanism 10E are likewise positioned in substantially vertical alignment with each other but the pairs of slits 40B are offset slightly horizontally with respect to the plurality of slits 40A. In addition, at least some of the pairs of slits 40B overlap vertically with at least some of the pairs of slits 40A as best shown in FIG. 9. This vertical overlapping allows for more pairs of slits to be arranged on each opposite side of the mechanism 10E.

Each respective opposed pair of slits or openings 40A and 40B are again positioned and located on the mechanism 10E so as to receive the straps associated with a typical knee pad such as the knee pad 12 illustrated in FIG. 2. In this regard, as best illustrated in FIG. 10, the fastening straps 16 associated with a typical knee pad 12 are fed through a respective opposed pair of elongated slits 40A or 40B. A user will select the appropriate pair of opposed elongated slits 40A or 40B based upon the size of the knee pad 12 and the positioning and location of the fastening straps 16 as well as where the user wants to position the knee pad relative to that user's knee. It is recognized that the upper fastening strap 16 associated with the typical knee pad may be fed through a pair of elongated openings 40A, while the lower fastening strap 16 may be fed through either a corresponding pair of opposed elongated slits 40A, or through a corresponding pair of opposed elongated slits 40B, or vice versa. The positioning and location of the plurality of opposed pairs of elongated slits 40A and 40B allows a user to adjust the position and location of a particular knee pad relative to that person's knee.

It is also recognized and anticipated that the offset pairs of opposed elongated slits 40B can be eliminated and the present mechanism 10E can include just a plurality of opposed elongated slits 40A positioned in substantial vertical alignment with each other. Use of the offset pairs of opposed elongated slits 40B allows for the positioning of additional opposed elongated slits on the same mechanism 10E and provides a user with more options for adjusting a particular knee pad to that person's knee. This embodiment provides more flexibility and more adjustable options to the intended user depending both upon the particular style, shape and dimensions associated with a typical knee pad 12 and the fastening straps 16 associated therewith, as well as positioning such knee pad in relationship to a user's knee.

It is also recognized and anticipated that the present mechanisms 10D and 10E can likewise be fabricated so as to include the pocket 22 associated with the mechanisms, 10A, 10B and 10C. In this embodiment, the pockets 22 can be formed in mechanisms 10D and 10E by attaching the first length of fabric material 18 to the second fabric material 20 on three sides thereof, or in any other manner which forms a pocket 22. Again, the pocket 22 is designed for receiving a typical knee pad 12 and, if the knee pad 12 is inserted within a pocket 22 formed in embodiments 10D and 10E, the fastening straps 16 associated therewith can again be fed through the respective opposed openings 24D and 24E, or the opposed pairs of elongated slits 40A and/or 40B as previously explained.

It is also recognized and anticipated that the present mechanisms 10A, 10B, 10C, 10D and 10E can be utilized with any particular garment and can be used to hold a pad over any particular region of that garment. For example, the present mechanisms 10A, 10B, 10C, 10D and 10E can be easily used in the elbow region of a particular garment for receiving and holding an elbow pad. Any of the various embodiments of the present mechanisms 10A, 10B, 10C, 10D and 10E can be used to accomplish this utility and the present mechanisms are not limited solely for use with a knee pad.

It is also recognized and anticipated that the pockets 22 associated with the mechanisms 10B, 10C, 10D and 10E can likewise be formed by attaching the first length of fabric material 18 directly to the underlying garment such as to the front knee region of the pantleg 14, or to the elbow region of a shirt sleeve or other garment. As discussed with respect to the mechanism 10A, in these particular embodiments, the second length of fabric material 20 is not used and instead the particular region of the garment over which the first length of fabric material 18 is positioned to form the pocket 22 actually forms the second length of fabric 20. In all other respects, the mechanisms 10B, 10C and 10D function and operate as previously discussed.

Thus, there has been shown and described several embodiments of a novel pad holding mechanism. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A knee pad holding mechanism integrally formed with a pantleg for holding a knee pad over a knee region of the pantleg comprising:

a first length of fabric material and a second length of fabric material secured together to form a pocket, said pocket including a top portion and a bottom portion, an access opening, opposed side edges and an interior, said pocket being sized and shaped to receive the knee pad through the access opening and further including at least two respective pairs of pocket openings located along each of the opposed side edges of said pocket for providing access to the interior of said pocket, each of said pocket openings having opposed top and bottom portions and each of said at least two respective pairs of pocket openings being sized and shaped to receive a strap associated with the knee pad;

a first cord member extending from the top portion to the bottom portion of one of the opposed side edges of said pocket and a second cord member extending from the top portion to the bottom portion of the other of the opposed side edges of said pocket;

said first cord member passing within the respective pocket openings associated with said one of the opposed side edges of said pocket and extending from the top portion to the bottom portion of each of the respective pocket openings thereby forming an additional opening within each of the respective pocket openings for allowing the strap associated with the knee pad to also be threaded therethrough;

said second cord member passing within the respective pocket openings associated with said other of the opposed side edges of said pocket and extending from the top portion to the bottom portion of each of the respective pocket openings thereby forming an additional opening within each of the respective pocket openings for allowing the strap associated with the knee pad to also be threaded therethrough;

said pocket being secured to the knee region of the pantleg;

each pair of said at least two respective pairs of opposed pocket openings providing adjustability of the knee pad relative to the knee region of the pantleg.

2. A knee pad holding mechanism integrally formed with a pantleg for holding a knee pad over a knee region of the pantleg comprising:

a first length of fabric material secured to the knee region of a pantleg to form a pocket with the pantleg, said pocket including a top portion and a bottom portion, an access opening, opposed side edges and an interior, said pocket being sized and shaped to receive the knee pad through said access opening and further including at least two respective pairs of pocket openings located along each of the opposed side edges of said pocket for providing access to the interior of said pocket, each of said pocket openings having top and bottom portions and each of said at least two respective pairs of pocket openings being sized and shaped to receive a strap associated with the knee pad;

a first cord member extending from the top portion to the bottom portion of one of the opposed side edges of said pocket opening and a second cord member extending from the top portion to the bottom portion of the other of the opposed side edges of said pocket;

said first cord member passing within the respective pocket openings associated with said one of the opposed side edges of said pocket and extending from the top portion to the bottom portion of each of the respective pocket openings thereby forming an additional opening within each of the respective pocket openings for allowing the strap associated with the knee pad to also be threaded therethrough;

said second cord member passing within the respective pocket openings associated with said other of the opposed side edges of said pocket and extending from the top portion to the bottom portion of each of the respective pocket openings thereby forming an additional opening within each of the respective pocket openings for allowing the strap associated with the knee pad to also be threaded therethrough;

said pocket positioning and securing the knee pad over the knee region of the pantleg when the knee pad is positioned within said pocket;

each pair of said at least two respective pairs of opposed pocket openings providing adjustability of the knee pad relative to the knee region of the pantleg.

3. A pad holding mechanism integrally formed with a garment for holding a pad over a particular region of the garment comprising:

a first length of fabric material and a second length of fabric material secured together to form a pocket, said pocket including a top portion and a bottom portion, at least one access opening, opposed side edges and an interior, said pocket being sized and shaped to receive the pad through said at least one access opening and further including at least two respective pairs of pocket openings located along each of the opposed side edges of said pocket for providing access to the interior of said pocket, each of said pocket openings having opposed top and bottom portions and each of said at least two respective pairs of pocket openings being sized and shaped to receive a strap associated with the pad;

a first cord member extending from the top portion to the bottom portion of one of the opposed side edges of said pocket and a second cord member extending from the top portion to the bottom portion of the other of the opposed side edges of said pocket;

said first cord member passing within the respective pocket openings associated with said one of the opposed side edges of said pocket and extending from the top portion to the bottom portion of each of the respective pocket openings thereby forming an additional opening within each of the respective pocket openings for allowing the strap associated with the pad to also be threaded therethrough;

said second cord member passing within the respective pocket openings associated with said other of the opposed side edges of said pocket and extending from the top portion to the bottom portion of each of the respective pocket openings thereby forming an additional opening within each of the respective pocket openings for allowing the strap associated with the knee pad to also be threaded therethrough;

said pocket being secured to the particular region of the garment for positioning and securing the pad therewithin;

each pair of said at least two respective pairs of opposed pocket openings providing adjustability of the pad relative to the particular region of the garment to which said pocket is secured.

4. The pad holding mechanism of claim 3 wherein the particular region of the garment to which said pocket is secured is the knee region of a pantleg.

5. A pad holding mechanism integrally formed with a garment for holding a pad over a particular region of the garment comprising:

a first length of fabric material secured to the particular region of the garment to form a pocket with the garment, said pocket including a top portion and a bottom portion, at least one access opening, opposed side edges and an interior, said pocket being sized and shaped to receive the pad through said at least one access opening and further including at least two respective pairs of pocket openings located along each of the opposed side edges of said pocket for providing access to the interior of said pocket, each of said pocket openings having opposed top and bottom portions and each of said at least two respective pairs of pocket openings being sized and shaped to receive a strap associated with the pads;

a first cord member extending from the top portion to the bottom portion of one of the opposed side edges of said pocket and a second cord member extending from the top portion to the bottom portion of the other of the opposed side edges of said pocket;

said first cord member passing within the respective pocket openings associated with said one of the opposed side edges of said pocket and extending from the top portion to the bottom portion of each of the respective pocket openings thereby forming an additional opening within each of the respective pocket openings for allowing the strap associated with the pad to also be threaded therethrough;

said second cord member passing within the respective pocket openings associated with said other of the opposed side edges of said pocket and extending from the top portion to the bottom portion of each of the respective openings thereby forming an additional opening within each of the respective pocket openings for allowing the strap associated with the knee pad to also be threaded therethrough;

said pocket positioning and securing the pad over the particular region of the garment to which the first length of fabric material is attached when the pad is positioned within said pocket;

each pair of said at least two respective pairs of opposed pocket openings providing adjustability of the pad relative to the particular region of the garment to which said pocket is secured.

6. A knee pad holding mechanism integrally formed with a pantleg for holding a knee pad over a knee region of the pantleg comprising:

a first length of fabric material and a second length of fabric material secured together to form a pocket, said pocket including at least one access opening, opposed side edges and an interior, said pocket being sized and shaped to receive the knee pad through said at least one access opening and further including at least one pocket opening located along each of the opposed side edges of said pocket for providing access to the interior of said pocket, each of said at least one pocket opening having a top portion and a bottom portion and each of said at least one pocket opening being sized and shaped to receive a strap associated with the knee pad;

a first cord member extending from the top portion to the bottom portion of said at least one pocket opening associated with one of the opposed side edges of said pocket, said first cord member passing within said at least one pocket opening thereby forming an additional opening within said at least one pocket opening for allowing the strap associated with the knee pad to also be threaded therethrough; and a second cord member extending from the top portion to the bottom portion of said at least one pocket opening associated with the other of the opposed side edges of said pocket, said second cord member passing within said at least one pocket opening thereby forming an additional opening within said at least one pocket opening for allowing the strap associated with the knee pad to also be threaded therethrough;

said pocket being secured to the knee region of the pantleg.

7. The knee pad holding mechanism of claim 6 wherein said at least one pocket opening includes a plurality of pocket openings located along each of the opposed side edges of said pocket.

8. A knee pad holding mechanism integrally formed with a pantleg for holding a knee pad over a knee region of the pantleg comprising:

a first length of fabric material secured to the knee region of the pantleg to form a pocket with the pantleg, said pocket including at least one access opening, opposed side edges and an interior, said pocket being sized and shaped to receive the knee pad through said at least one access opening and further including at least one pocket opening located along each of the opposed side edges of said pocket for providing access to the interior of said pocket, each of said at least one pocket opening having a top portion and a bottom portion and each of said at least one pocket opening being sized and shaped to receive a strap associated with the knee pad;

a first cord member extending from the top portion to the bottom portion of said at least one pocket opening associated with one of the opposed side edges of said pocket, said first cord member passing within said at least one pocket opening thereby forming an additional opening within said at least one pocket opening for allowing the strap associated with the knee pad to also be threaded therethrough; and a second cord member extending from the top portion to the bottom portion of said at least one pocket opening associated with the other of the opposed side edges of said pocket, said second cord member passing within said at least one pocket opening thereby forming an additional opening within said at least one pocket opening for allowing the strap associated with the knee pad to also be threaded therethrough;

said pocket positioning and securing the knee pad over the knee region of the pantleg when the knee pad is positioned within said pocket.

9. The knee pad holding mechanism of claim 8 wherein said at least one pocket opening includes a plurality of pocket openings located along each of the opposed side edges of said pocket.

* * * * *